United States Patent [19]

Barbador

[11] Patent Number: 4,969,645

[45] Date of Patent: Nov. 13, 1990

[54] PORTABLE GAME APPARATUS

[76] Inventor: David L. Barbador, 11 Simcoe Street, Collingwood, Ontario, Canada, L9Y 1H5

[21] Appl. No.: 406,241

[22] Filed: Sep. 12, 1989

[51] Int. Cl.[5] ..... A63B 39/00

[52] U.S. Cl. ..... 273/30; 273/DIG. 30

[58] Field of Search ..... 273/30, DIG. 30, 67 R, 273/85 F

[56] References Cited

U.S. PATENT DOCUMENTS

| | | | |
|---|---|---|---|
| 1,553,682 | 9/1925 | Froud et al. | 273/30 |
| 2,066,724 | 1/1937 | Forsyth | 273/30 |
| 2,665,908 | 1/1954 | Gray | 273/30 |
| 3,874,666 | 4/1975 | Ross | 273/DIG. 30 |
| 4,030,734 | 6/1977 | Castellucci | 273/30 |

FOREIGN PATENT DOCUMENTS

| | | | |
|---|---|---|---|
| 64782 | 1/1975 | Canada | 273/30 |
| 1478055 | 1/1969 | Fed. Rep. of Germany | 273/30 |

*Primary Examiner*—Theatrice Brown

*Attorney, Agent, or Firm*—Nies, Kurz, Bergert & Tamburro

[57] ABSTRACT

The invention relates to a game table having first and second flat surface halves attached in an edge-to-edge relationship to define a flat horizontal playing surface. Each of the flat playing surface halves is provided with a pair of spaced apart slots at each side edge thereof, the slots on the first table half being aligned with the slots on the second table half. There is provided first and second longitudinally extending vertical walls. Each of the walls being supported vertically by a pair of aligned slots on the first and second table halves. An upstanding barrier extends transversely across the playing surface at the edge-to-edge attachment of the table halves. Each of the table halves is provided with indicia defining a service area for playing the game of table tennis.

8 Claims, 1 Drawing Sheet

PORTABLE GAME APPARATUS

BACKGROUND OF THE INVENTION

This invention relates generally to game apparatus and more particularly to a novel table tennis type game apparatus which is portable and which may be set up and played on any flat surface such as a table or a floor.

The standard popular table tennis or ping-pong game usually includes a rectangular table of substantial size and weight which when assebled and supported in its upright position remains in place and occupies a significant amount of space within a room. It is not easily moved from one location to another. In addition, various modifications to the standard table tennis game have been proposed by providing rebound surfaces from which the ball may be deflected, thus affording the players with a wide variety of possible shots during play of the game. Typical prior proposals are illustrated in U.S. Pat. Nos. 4,030,734, 3,738,653, 3,059,927, 2,688,484 and 2,313,701. However in all these prior designs, the various game elements once assembled are retained in place and it is a cumbersome chore to try to move the apparatus about.

SUMMARY OF THE INVENTION

Accordingly it is a primary object of this invention to provide a novel table type game apparatus which is portable, convenient to handle and store, easy to assemble and disassemble, and playable on any flat support surface such as a floor or table.

Another object of the invention is to provide the above novel table type tennis game apparatus wherein the respective game elements are quickly assembled and disassembled so that the game may be easily moved from one location to another.

Still another object of the invention resides in the provision of the above novel game apparatus comprising a pair of flat sheets adapted to be assembled adjacent each other to define a substantially horizontal playing surface, each of the sheets having a pair of laterally spaced, longitudinally extending slots which come in alignment when the sheets are assembled, and a pair of longitudinally extending vertical walls that fit within the slots on the adjacent sheets to secure the sheets and the walls together in sturdy fashion to permit play.

Still another object of the invention resides in the provision of the above novel game apparatus wherein the usual net extends across the playing surface and is fastened by way of Velcro connectors to the side walls for quick and easy assembly.

Other objects of the invention will become apparent from the following description of the drawings.

DETAILED DESCRIPTION OF THE INVENTION

Figure 1:
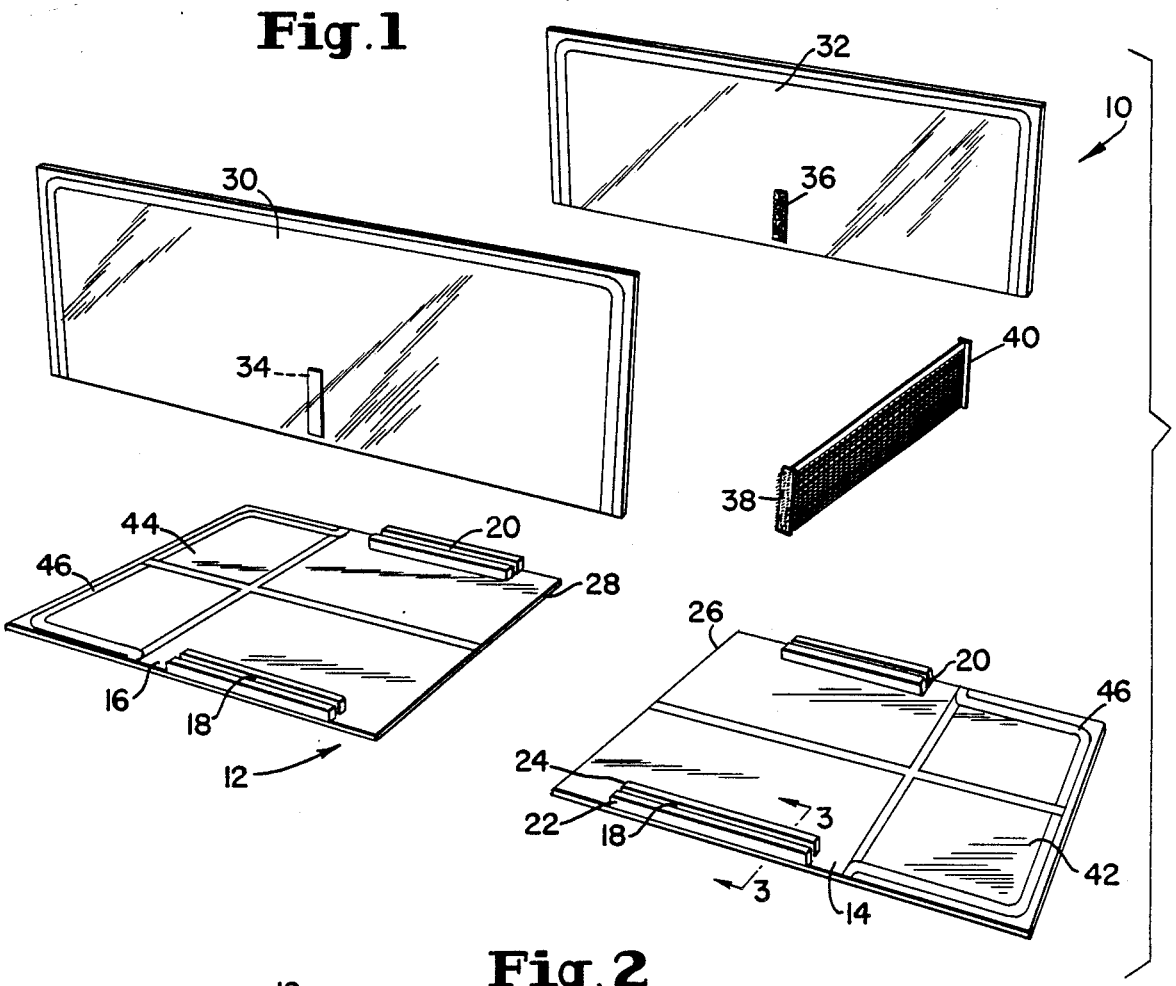
FIG. 1 is an exploded view of the game apparatus of the invention.
Figure 2:
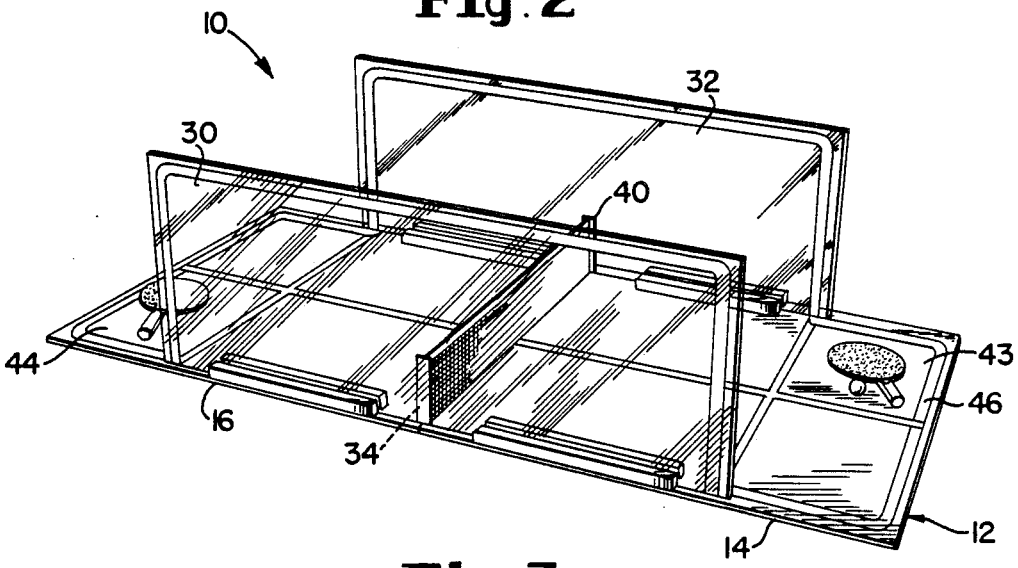
FIG. 2 is a perspective view illustrating the game as assembled.
Figure 3:
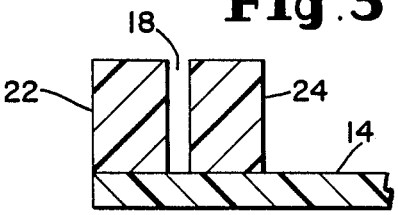
FIG. 3 is a fragmentary sectional view taken along line 3—3 of FIG. 1.

The novel game 10 of the invention includes a base section 12 formed by a pair of flat transparent plexiglass sheets 14 and 16, each 5mm thick and 3 feet square, the sheets when brought together as in FIG. 2 providing a flat horizontal rectangular playing surface 3 feet by 6 feet in size. A pair of laterally spaced, longitudinally extending channels or slots 18 and 20 extend parallel to each other on top of and adjacent the side edges of sheets 14 and 16, with each of the slots being formed by spaced strips 22 and 24 fixed on its respective sheet (see FIG. 3). When assembled as in FIG. 2 the inner edges 26 and 28 of sheets 14 and 16 engage each other and slots 18 and 20 of each of the sheets are in longitudinal alignment.

A pair of vertical side walls or wings 30 and 32 constructed of plexi-glass, 3mm thick by 18" high by 48" long fit snug within slots 18 and 20, respectively, the side walls being thereby supported in the upright position and locking sheets 14 and 16 together as shown in FIG. 2. Velcro connector strips 34 and 36 are adhesively fixed to walls 30 and 32 and extend vertically upwardly from the bottom edge thereof with strips 34 and 36 being centered end-to-end on the walls.

A standard type net 5" high extends laterally between walls 30 and 32 and has fixed on its ends Velcro connectors 38 and 40 which attach to connectors 34 and 36 when assembled.

Sheets 14 and 16 have end portions 42 and 44 which extend beyond the ends of walls 30 and 32 and have lined indicia 46 identifying acceptable service landing areas on base 12.

It is apparent that game 10 is very portable, convenient to handle and store, easy to assembly and disassemble, and playable on any flat support surface such as a floor or table.

Once assembled as in FIG. 2, the game may be played in the usual fashion using the standard paddles and ping-pong ball. However upon returning a serve, a player may choose to bank or deflect the ball off one of the side walls 30 and 32 before it lands on the playing surface of the server. Play proceeds back and forth permitting a wide variety of passes in either direction until the return of one of the players fails to land on the playing surface of his opponent.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Game apparatus for use with a ball and paddles comprising first and second flat sheet means assembled adjacent each other to define a substantially horizontal playing surface, means defining a pair of laterally spaced longitudinally extending slots on top of each of said sheet means, the slots on said first sheet means aligning longitudinally with the slots on said second sheet means, first and second longitudinally extending vertical wall means fitting within respective aligned slots to secure said first and second sheet means and said first and second wall means together, and upstanding barrier means extending transversely across said playing surface between said first and second wall means.

2. The game apparatus of claim 1, comprising means connecting said barrier means to said first and second wall means.

3. The game apparatus of claim 2, said connecting means being Velcro connectors.

4. The game apparatus of claim 1, whereby said first and second sheet means, said first and second wall means, and said barrier means may be quickly assembled on any suitable support surface and disassembled for convenient storage or movement to another support surface.

5. The game apparatus of claim 1, said first and second sheet means including indicia defining acceptable service areas on said playing surface.

6. Portable game apparatus comprising a ball and paddles, first and second flat sheet means assembled adjacent each other to define a substantially horizontal playing surface, means defining a pair of laterally spaced, longitudinally extending slots on top of each of said sheet means, the slots on said first sheet means aligning longitudinally with the slots on said second sheet means, first and second longitudinally extending vertical wall means fitting within respective aligned slots to secure said first and second sheet means and said first and second wall means together, and upstanding barrier means extending across said playing surface and connected to said first and second wall means.

7. The game apparatus of claim 6, whereby said first and second sheet means, said first and second wall means, and said barrier means may be quickly assembled on any suitable support surface and disassembled for convenient storage or movement to another support surface.

8. The game apparatus of claim 7, said first and second sheet means including indicia defining acceptable service areas on said playing surface.

* * * * *